US007812805B2

(12) United States Patent
Miura

(10) Patent No.: US 7,812,805 B2
(45) Date of Patent: Oct. 12, 2010

(54) DRIVER CIRCUIT AND DISPLAY DEVICE

(75) Inventor: Makoto Miura, Tsuruoka (JP)

(73) Assignee: NEC Electronics Corporation, Kanagawa (JP)

( * ) Notice: Subject to any disclaimer, the term of this patent is extended or adjusted under 35 U.S.C. 154(b) by 1394 days.

(21) Appl. No.: 11/251,890

(22) Filed: Oct. 18, 2005

(65) Prior Publication Data

US 2006/0103618 A1 May 18, 2006

(30) Foreign Application Priority Data

Nov. 12, 2004 (JP) ..... 2004-328699

(51) Int. Cl.
*G09G 3/36* (2006.01)

(52) U.S. Cl. ..... 345/96; 345/99; 345/212

(58) Field of Classification Search ..... 345/94–100, 345/204, 209, 212
See application file for complete search history.

(56) References Cited

U.S. PATENT DOCUMENTS 5,528,256 A * 6/1996 Erhart et al. ..... 345/96
5,748,165 A 5/1998 Kubota et al.
6,049,321 A * 4/2000 Sasaki ..... 345/99
7,084,852 B2 8/2006 Nishi et al.
2002/0041281 A1 * 4/2002 Yanagi et al. ..... 345/212

FOREIGN PATENT DOCUMENTS

CN 1115535 A 1/1996
CN 1444201 A 9/2003
JP 2001-515225 9/2001

* cited by examiner

*Primary Examiner*—Amare Mengistu
*Assistant Examiner*—Jennifer Zubajlo
(74) *Attorney, Agent, or Firm*—Young & Thompson

(57) ABSTRACT

To provide a driver circuit that enables reduction in the number of elements formed through a high-voltage process and in chip size. An embodiment of the present invention relates to a driver circuit for inversion-driving a liquid crystal display panel, including: a positive-polarity line transmitting a positive display signal relative to a common electrode signal; a negative-polarity line transmitting a negative display signal relative to the common electrode signal; a dot inversion switch circuit switching the positive-polarity line and the negative-polarity line from each other to be connected with a source line; a charge recovery circuit connected with the positive-polarity line through a positive charge recovery switch and connected with the negative-polarity line through a negative charge recovery switch; and a common short circuit connecting the positive-polarity line and the negative-polarity line with a common electrode.

7 Claims, 11 Drawing Sheets

DRIVER CIRCUIT AND DISPLAY DEVICE

BACKGROUND OF THE INVENTION

1. Field of the Invention

The present invention relates to a driver circuit and a display device.

2. Description of Related Art

Along with recent developments in advanced image/information-oriented society, and popularization of multimedia systems, flat display panels such as a liquid crystal display device have gained increasing importance. The liquid crystal display devices have been widely used as a display device of a portable terminal device etc. because of its low power consumption, slimness, light weight, and other such advantages.

In general, the liquid crystal display device includes a liquid crystal display panel for displaying an image, and a driver circuit for driving the liquid crystal display panel. The liquid crystal display panel includes: a TFT array substrate on which pixel electrodes are arranged in matrix, and switching elements such as TFTs (thin film transistors) are connected with the pixel electrodes; a counter substrate having formed thereon a common electrode opposite to the pixel electrodes; and liquid crystal filled in between the two substrates, for example.

Up to now, the following method has been used as a method of driving a liquid crystal display panel. That is, the voltage applied to liquid crystal is changed to thereby change the orientation of liquid crystal grains, and change the transmittance for multi-gray-scale display. According to this method, the voltage is changed within a range from a threshold voltage at which the transmittance starts varying to a saturation voltage that does not induce any further change in transmittance, in accordance with a desired gray scale to thereby change the transmittance for multi-gray-scale display.

When the liquid crystal display device is driven with DC voltage, a problem arises in that the display image causes burn-in due to, for example, degradation of liquid crystal components, and contamination with impurities mixed in the liquid crystal display panel. Therefore, an AC driving system such as a dot inversion driving system for changing a polarity of the driving voltage from one pixel to another pixel has been generally used. In the case of using this AC driving system, the common electrode is alternately applied with the positive voltage and the negative voltage, which consumes much power. To that end, there has been proposed a technique of saving power consumption using a charge recovery circuit (see Japanese Patent Translation Publication No. 2001-515225, for instance).

FIG. 11 is a circuit diagram showing a driver circuit of a conventional liquid crystal display panel having a charge recovery circuit. As shown in FIG. 11, the liquid crystal display device 10 includes a liquid crystal display panel 11 for displaying an image and a driver circuit 12. The driver circuit 12 includes plural operational amplifiers 13 supplying display signals. Each operational amplifier 13 is connected with a source line DL in the liquid crystal display panel 11. Each source line DL is connected with a first or second switch. The first switches are connected with, for example, the odd-numbered source lines DL, and connect between the odd-numbered source lines and the odd-numbered charge recovery lines. The second switches are connected with, for example, the even-numbered source line DL, and connect between the even-numbered source lines and the even-numbered charge recovery lines.

The odd-numbered charge recovery line and the even-numbered charge recovery line are each connected with a straight switch and a cross switch. The straight switch connects between the odd-numbered charge recovery line and one electrode of a positive-charge capacitor 14, or between the even-numbered charge recovery line and one electrode of a negative-charge capacitor 15. The cross switch connects between the odd-numbered charge recovery line and one electrode of the negative-charge capacitor 15 or between the even-numbered charge recovery line and one electrode of the positive-charge capacitor 14. The other electrodes of the positive-charge capacitor 14 and negative-charge capacitor 15 are connected with the common electrode in the liquid crystal display panel 11. Further, a neutralizing switch connects between the even-numbered charge recovery line and the odd-numbered charge recovery line.

As regards the dot inversion display, the polarity of the supplied display signal is inverted between the adjacent source lines DL. Accordingly, during a driving period, the positive display signal is applied to a first line, a second line next to the first line is applied with the negative display signal, and a third line next to the second line is applied with the positive display signal. During a subsequent gate line driving period, the first line is driven with the negative voltage, the second line is driven with the positive voltage, and the third line is drive with the negative voltage.

It is assumed here that the odd-numbered operational amplifiers supply the display signals of the positive polarity relative to the reference voltage, and the even-numbered operational amplifiers supply the display signals of the negative polarity relative to the reference voltage. After the image display, the charge recovery is executed. Upon the charge recovery, the first and second switches are turned on. Thus, the even-numbered source lines DL are connected with the even-numbered charge recovery lines, and the odd-numbered source lines DL are connected with the odd-numbered charge recovery lines. Then, the straight switches are turned on. Through this operation, the odd-numbered charge recovery lines are connected with the positive-charge capacitor 14, and the even-numbered charge recovery lines are connected with the negative-charge capacitor 15.

Through the above operation, charges accumulated in the pixel electrodes are recovered to each capacitor. Thereafter, the even-numbered charge recovery lines and the odd-numbered charge recovery lines are disconnected from the positive-charge capacitor 14 and the negative-charge capacitor 15, respectively. Then, the neutralizing switch is turned on, thereby electrically connecting between the even-numbered charge recovery line and the odd-numbered charge recovery line to set the source line DL at a reference potential. After that, the neutralizing switch is turned off, and two cross switches are turned on. This establishes the connection between the even-numbered charge recovery lines and the positive-charge capacitor 14 and between the odd-numbered charge recovery lines and the negative-charge capacitor 15. As a result, charges accumulated in the capacitors are transferred to the pixel electrodes to save the power consumption.

In the case of using the above charge recovery circuit, the charges of the plural source lines DL should be recovered by use of the straight switches and the cross switches, each of which are connected with the even-numbered charge recovery lines and odd-numbered charge recovery lines in a one-to-one correspondence. Hence, it is necessary to use the straight switch and cross switch having a high withstand voltage. For integration of the driver circuit having such a charge recovery circuit, the circuit is manufactured through a high-voltage process.

In the high-voltage process, the larger gate length or gate oxide film thickness is required for increasing the withstand voltage of the switches. This leads to a problem of an increased chip size. Besides, the switches are applied with both the positive and negative driving voltages for the liquid crystal, so a power source voltage of the driver circuit needs to be twice or more as high as the driving voltage for the liquid crystal. As a result, the power consumption is increased.

SUMMARY OF THE INVENTION

The present invention provides a driver circuit for inversion-driving a liquid crystal display panel, including: a positive-polarity line transmitting a positive display signal relative to a reference voltage; a negative-polarity line transmitting a negative display signal relative to the reference voltage; a switching part switching the positive-polarity line and the negative-polarity line from each other to be connected with a source line; and a charge recovery circuit part connected with the positive-polarity line through a first switching element and connected with the negative-polarity line through a second switching element. According to the driver circuit of the present invention, the total power consumption of the driver circuit can be reduced.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Figure 1:
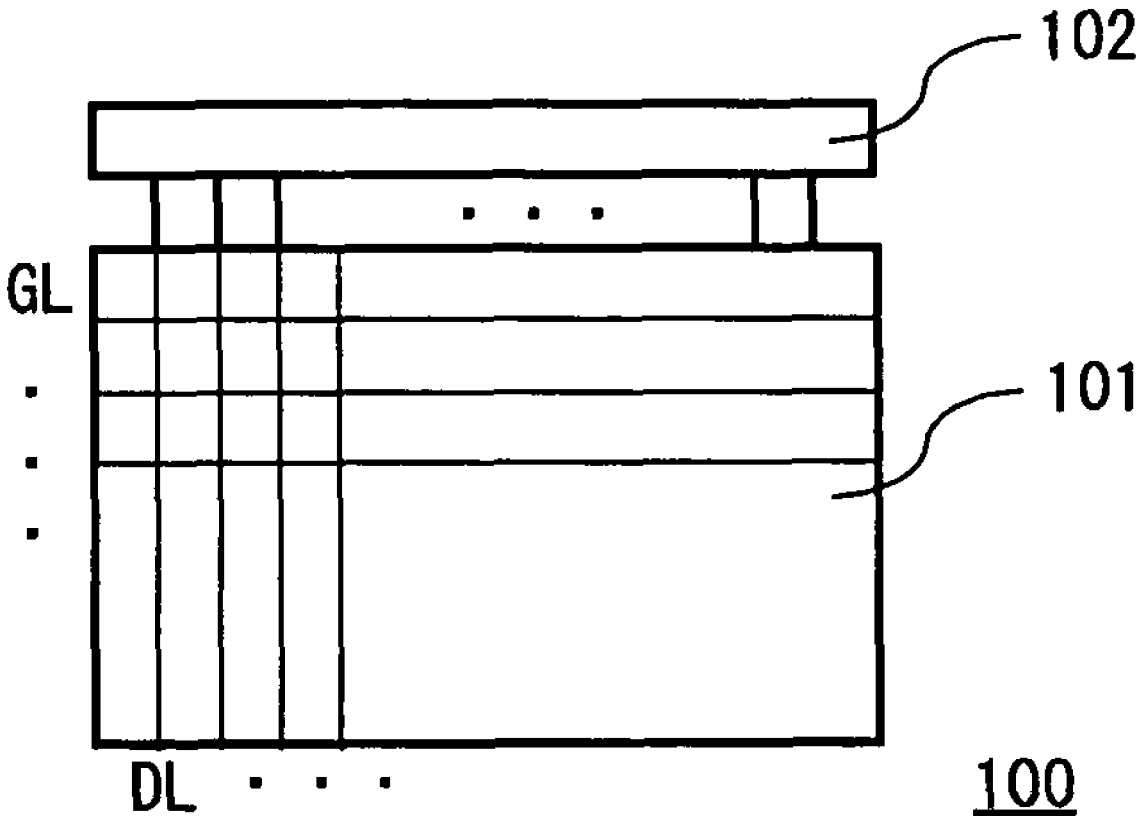
FIG. 1 shows a structural example of a liquid crystal display device according to a first embodiment of the present invention.

Referring to FIG. 1, a display device according to an embodiment of the present invention is described. Herein, a TN type active matrix liquid crystal display device is given as an example of the display device. Further, this embodiment adopts a dot inversion driving system. FIG. 1 is a schematic diagram showing a liquid crystal display device 100 according to this embodiment. The liquid crystal display device 100 includes a liquid crystal display panel 101 for displaying an image and a driver circuit 102 for supplying power.

The liquid crystal display panel 101 having a display area composed of plural pixels is structured such that liquid crystal is filled in between a TFT (thin film transistor) array substrate (not shown) and a counter substrate (not shown) which is opposite thereto. The TFT array substrate has gate lines GL (scanning lines) extending in the horizontal direction, source lines DL (signal lines) extending in the vertical direction, and TFTs provided around the intersection between the gate lines GL and the source lines DL. Further, plural pixel electrodes are arranged in matrix between the gate lines GL and the source lines DL. The TFT has a gate connected with the gate line GL, a source connected with the source line DL, and a drain connected with the pixel electrode.

On the other hand, formed on the counter substrate are a common electrode, and color filters of R (red), G (green), and B (blue). The common electrode is a transparent electrode formed opposite to the pixel electrode, on almost the entire surface of the counter substrate in practice. Each gate line GL is supplied with scanning signals, and all TFTs connected with a gate line GL selected with each scanning signal are concurrently turned on. Then, each source line DL is supplied with display signals to accumulate charges corresponding to the display signal, in the pixel electrode.

The orientation of liquid crystal grains between the pixel electrode and the common electrode changes depending on a potential difference between the pixel electrode receiving the display signal and the common electrode. Thus, it is controlled how much the light incident from a backlight (not shown) passes through the substrate. Each pixel of the liquid crystal display panel 101 displays an image in various colors depending on a color tone corresponding to the amount of transmitted light and color of R, G, or B. It should be noted that the color filters may be omitted for a black-and-while image.

This embodiment adopts the dot inversion driving system by way of example. The polarity of the display signal supplied to the pixel electrode connected with one gate line GL is inverted in turn, and inverted every gate line GL. The polarity of each display signal is switched every frame. Here, the "positive (+)" polarity means that the potential of the display signal supplied from the source line exceeds the potential of the common electrode; the "negative (−)" polarity means that the potential is below the common electrode potential. The common electrode potential may be kept constant as a reference potential, or may be inverted periodically in response to the inversion of the polarity of the display signal.

The driver circuit 102 generates the display signal based on externally supplied image signals. The driver circuit 102 is well known to include a decoder, a shift register circuit, a latch circuit, and an operational amplifier (not shown). At the time of the above dot inversion driving, a positive-polarity signal and a negative-polarity signal are each input to the driver circuit 102 as an image signal. Alternatively, positive- and negative-polarity image signals may be a common signal, and the latch circuit may switch the signal.

A feature of the present invention resides in the driver circuit 102. Hereinafter, the driver circuit 102 is detailed with reference to the accompanying drawings.

First Embodiment

Figure 2:
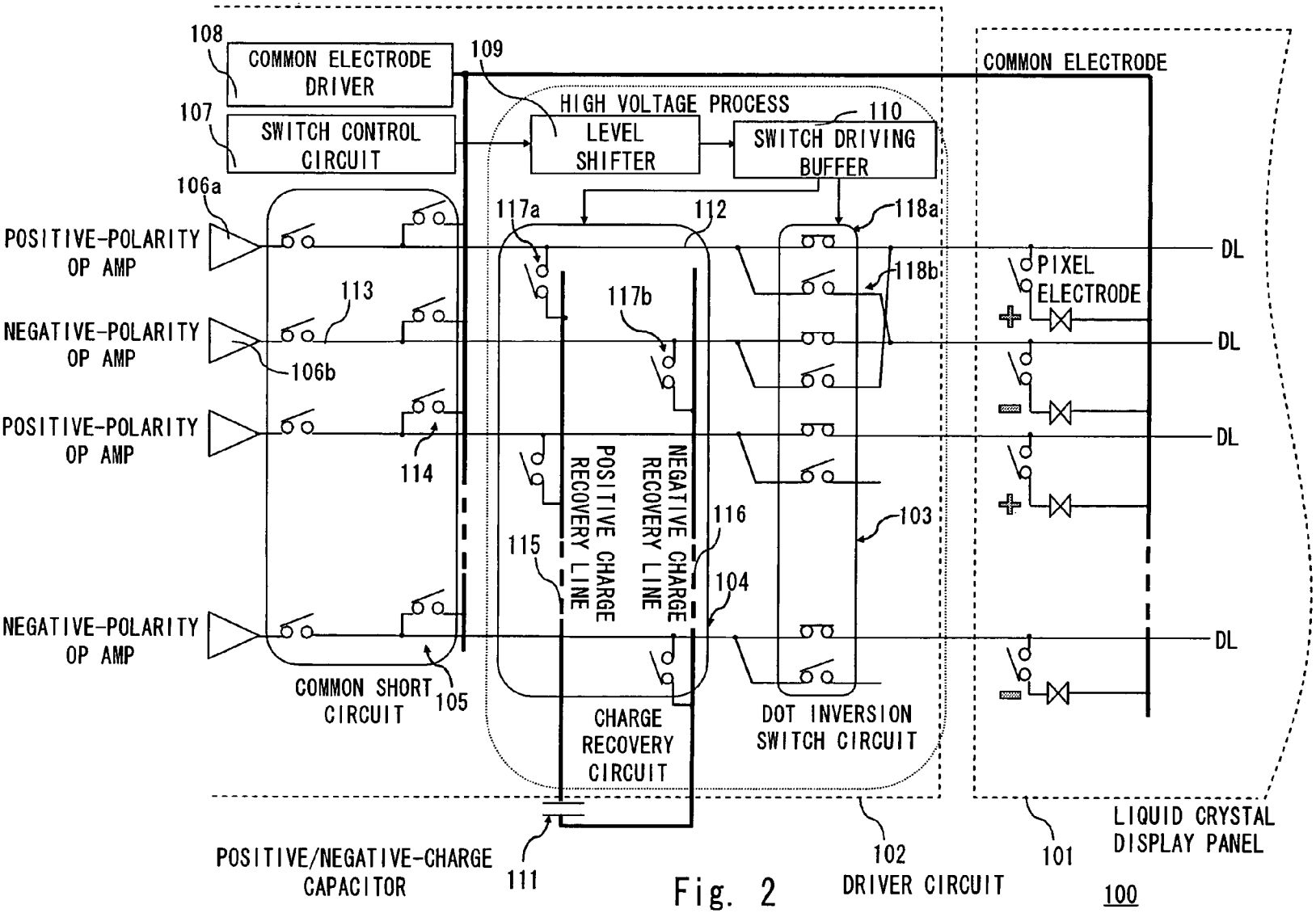
FIG. 2 shows the configuration of a driver circuit according to the first embodiment.

FIG. 2 is a circuit diagram showing the driver circuit 102 according to a first embodiment. The driver circuit 102 includes a dot inversion switch circuit 103, a charge recovery circuit 104, a common short circuit 105, an operational amplifier 106, a switch control circuit 107, a common electrode driver 108, a level shifter 109, and a switch driving buffer 110. For illustrative purposes, pixels in the liquid crystal display panel 101 are shown. In FIG. 2, the horizontal direction of the liquid crystal display panel 101 is defined as a direction in which the source line DL extends, and the vertical direction is defined as a direction in which the gate line GL extends.

In this embodiment, the operational amplifier 106, the common short circuit 105, the charge recovery circuit 104, and the dot inversion switch circuit 103 are arranged in the stated order. Arranged on the output side of the dot inversion switch circuit 103 is the liquid crystal display panel 101.

As shown in FIG. 2, in this embodiment, positive-polarity circuits and negative-polarity circuits are alternately arranged. The operational amplifiers 106 amplify and output the display signals generated in the driver circuit 102. In this embodiment, the operational amplifiers 106 are divided into two: an amplifier outputting a positive-polarity display signal (hereinafter referred to as positive-polarity operational amplifier 106*a*) and an amplifier outputting a negative-polarity display signal (hereinafter referred to as negative-polarity operational amplifier 106*b*). As mentioned above, the positive-polarity operational amplifiers 106*a* and the negative-polarity operational amplifiers 106*b* are alternately arranged. In this embodiment, the positive-polarity operational amplifiers 106*a* are provided corresponding to the odd-numbered source lines DL, and the negative-polarity operational amplifiers 106*b* are provided corresponding to the even-numbered source lines DL.

The output terminal of each positive-polarity operational amplifier 106*a* is connected with the positive-polarity line 112 through a switch. Further, the output terminal of each negative-polarity operational amplifier 106*b* is connected with the negative-polarity line 113 through a switch. Thus, the positive-polarity line 112 transmits the positive display signal, while the negative-polarity line 113 transmits the negative display signal.

The common short circuit 105 is arranged on the output side of each operational amplifier 106. The common short circuit 105 shorts the pixel electrode to the common electrode potential, saving the power consumption. The common short circuit 105 includes plural common short switches 114. The positive-polarity line 112 and the negative-polarity line 113 are each connected with the common short switch 114. The common short switch 114 connects the positive-polarity line 112 and the negative-polarity line 113 to the common potential.

Here, a signal that determines the potential of the common electrode is supplied from the common electrode driver 108 in the driver circuit 102.

The charge recovery circuit 104 is provided on the output side of the common short circuit 105. The charge recovery circuit 104 recovers charges accumulated in the pixel electrode into the positive/negative-charge capacitor 111 through the source lines DL, and then emits and supplies the charges recovered into the positive/negative-charge capacitor 111, to the pixel electrode upon the next writing of a display signal. Through this operation, the charges to be supplied to the pixel electrode can be reduced, and the driver circuit is not required of the high ability to drive the source line DL. Accordingly, this contributes to reduction in total power consumption of the driver circuit.

The charge recovery circuit 104 includes the positive-charge recovery line (first recovery line) 115, the negative-charge recovery line (second recovery line) 116, the charge recovery switch 117, and the positive/negative-charge capacitor 111. The positive-charge recovery line 115 and the negative-charge recovery line 116 cross the positive-polarity line 112 and the negative-polarity line 113. The positive-charge recovery line 115 is connected with the positive-polarity line 112 through a positive-charge recovery switch 117*a*. On the other hand, the negative-charge recovery line 116 is connected with the negative-polarity line 113 through a negative-charge recovery switch 117*b*. The positive-charge recovery line 115 is connected with one electrode of the positive/negative-charge capacitor 111. Further, the negative-charge recovery line 116 is connected with the other electrode of the positive/negative-charge capacitor 111.

The dot inversion switch circuit 103 is provided on the output side of the charge recovery circuit 104. The dot inversion switch circuit 103 selects one of the positive-polarity line 112 and the negative-polarity line 113 to be connected with the source line DL depending on the polarity of the display signal applied to the pixel electrode. In other words, either the positive-polarity line 112 or the negative-polarity line 113 is connected with the source line DL depending on the polarity of the display signal output from the operational amplifier 106*a*, 106*b*. Further, The dot inversion switch circuit 103 selects one of the positive-polarity line 112 and the negative-polarity line 113 to be connected with the source line DL according to the polarity of charges transferred at the time of recovering the charges accumulated in the pixel electrode into the positive/negative-charge capacitor 111 of the charge recovery circuit 104 and at the time of emitting the charges accumulated in the positive/negative-charge capacitor 111.

For example, if the pixel electrode is supplied with the positive display signals, the dot inversion switch circuit 103 is controlled in such a manner as to connect the source line DL with the positive-polarity operational amplifier 106*a*. Besides, if the pixel electrode is supplied with the negative display signal, the dot inversion switch circuit 103 is controlled in such a manner as to connect the source line DL with the negative-polarity operational amplifier 106*b*.

The dot inversion switch circuit 103 includes plural dot inversion switches 118. The positive-polarity lines 112 and the negative-polarity lines 113 are each connected with the dot inversion switch 118. In this embodiment, the dot inversion switch connecting the odd-numbered source line DL in the liquid crystal display panel 101 with the positive-polarity line 112, and the dot inversion switch connecting the even-numbered source line DL with the negative-polarity line 113 are referred to as forward connection switches 118*a*. Also, the dot inversion switch connecting the odd-numbered source line DL with the negative-polarity line 113 and the dot inversion switch connecting the even-numbered source line DL with the positive-polarity line 112 are referred to as cross connection switches 118*b*.

The switch control circuit 107 controls switches provided to the dot inversion switch circuit 103, the charge recovery circuit 104, and the common short circuit 105. Signals output from the switch control circuit 107 are supplied to each switch as switch driving signals through the level shifter 109, and the switch driving buffer 110.

Figure 3A:
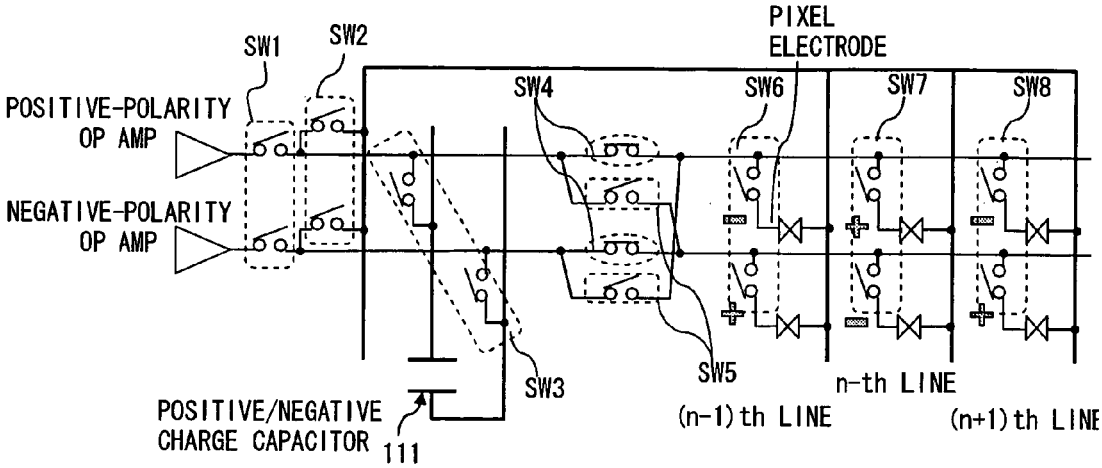
FIG. 3A illustrates an operation of the driver circuit according to the first embodiment.
Figure 3B:
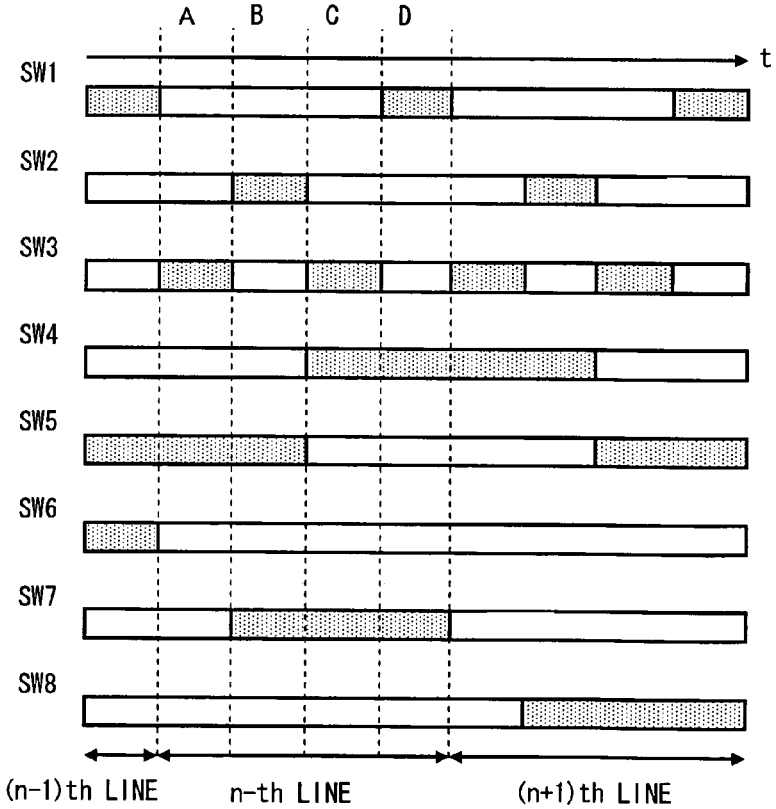
FIG. 3B is a timing chart illustrative of on/off timings of each switch of the driver circuit according to the first embodiment.
Figure 4:
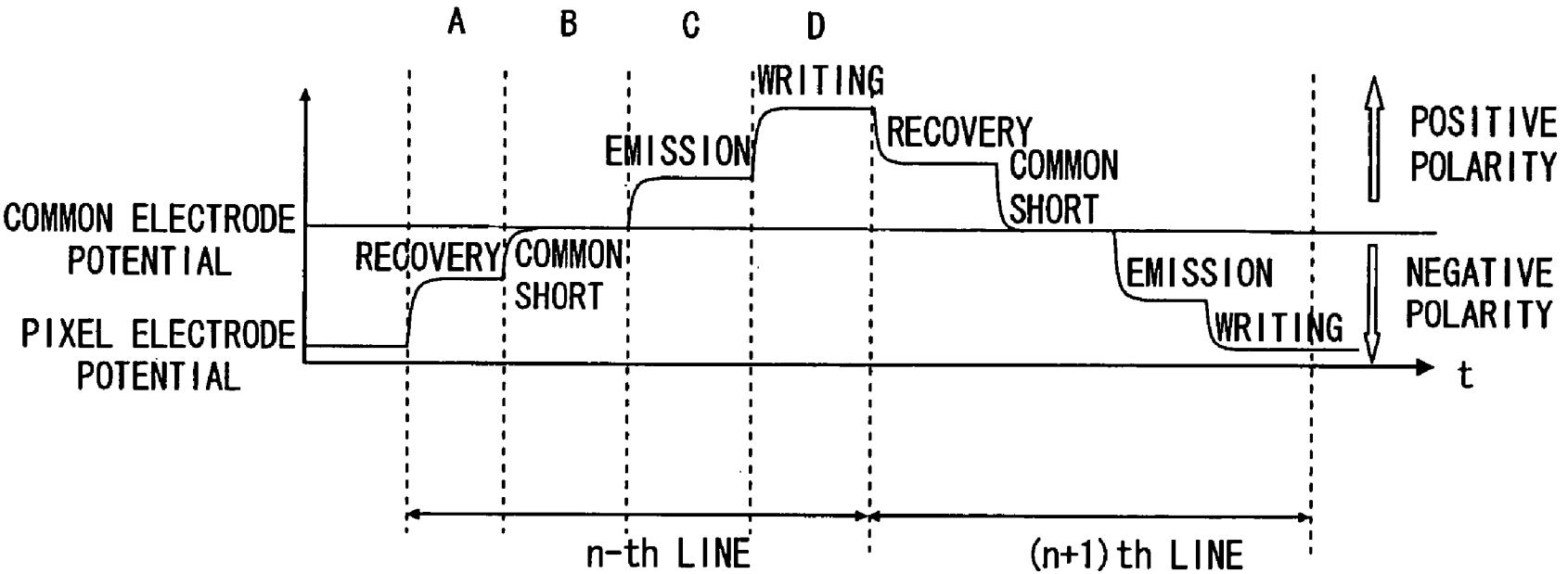
FIG. 4 is a waveform diagram showing the potential of a pixel electrode with the use of the driver circuit according to the first embodiment.

Referring now to FIGS. 3A to 4, the operation of the driver circuit 102 according to the first embodiment is described. FIGS. 3A and 3B illustrate the operation of the driver circuit 102. FIG. 3A illustrates two adjacent pixel electrodes connected with the (n−1)th gate line, n-th gate line, and (n+1)th gate line. FIG. 3B is a timing chart illustrative of on/off timings of each switch. In a hatched period of FIG. 3B, the switches are turned on. FIG. 4 shows a potential waveform of an upper pixel of the n-th line of FIG. 3A. The periods A to D in FIG. 3B correspond to the periods A to D of FIG. 4.

First of all, the signal is written to the pixel electrode in the (n−1)th line. A switch SW1 provided on the output terminal side of the operational amplifier is turned on, and at the same time, a cross connection switch SW5 and a pixel electrode switch SW6 on the (n−1)th line are turned on to thereby supply the negative display signal to the upper pixel and the positive display signal to the lower pixel. Next, the charges are supplied to the pixel electrode in the n-th line. The switches SW1 and SW6 are turned off while a charge recovery switch SW3 is turned on. At this time, the cross connection switch SW5, which was turned on at the time of writing the signal to the (n−1)th line, is kept on (charge recovery period A).

With such wiring, the negative charges accumulated in the upper pixel electrode in the n-th line through the previous writing operation can be transferred to one electrode of the positive/negative-charge capacitor 111 via the negative-charge recovery line. Then, the positive charges accumulated in the lower pixel electrode in the n-th line through the previous writing operation can be transferred to the other electrode of the positive/negative-charge capacitor 111 via the positive-charge recovery line. As the charge recovery period A of FIG. 4 shows, the negative charges accumulated in the upper pixel electrode in the n-th line are recovered to raise the potential of the pixel electrode.

After that, the charge recovery switch SW3 is turned off, and the common short switch SW2 and the pixel electrode switch SW7 in the n-th line are turned on. At this time, the cross connection switch SW5 is kept on (common short period B). With this wiring, the potential of the pixel electrode is made equal to the potential of the common electrode. As the common short period B of FIG. 4 shows, the negative pixel electrode has the potential equal to the common electrode potential.

Then, the common short switch SW2 and the cross connection switch SW5 are turned off, and the charge recovery switch SW3 and the forward connection switch SW4 are turned on (charge emission period C). With this wiring, the charges accumulated in the positive/negative-charge capacitor 111 of the charge recovery circuit 104 are emitted and accumulated in the pixel electrode in the n-th line. More specifically, negative charges accumulated in one electrode of the positive/negative-charge capacitor 111 can be transferred to the lower pixel electrode in the n-th line through the negative-charge recovery line. Further, positive charges accumulated in the other electrode of the positive/negative-charge capacitor 111 can be transferred to the upper pixel electrode in the n-th line through the positive-charge recovery line (see charge emission period C of FIG. 4).

After that, the charge recovery switch SW3 is turned off, and the switch SW1 is turned on to write the signal to the pixel electrode in the n-th line (writing period D). The display signal in the n-th line has the polarity opposite to that in the (n−1)th line, so the forward connection switch SW4 and the pixel electrode switch SW7 in the n-th line are kept on. The pixel electrode is supplied with a desired display signal from the operational amplifier 106 to display a desired image (see writing period D of FIG. 4).

Next, the charges are supplied to the pixel electrode in the (n+1)th line. The switch SW1 and the switch SW7 are turned off while the charge recovery switch SW3 is turned on. At this time, the forward connection switch SW4, which was turned on at the time of writing the signal to the n-th line, is kept on.

With this wiring, positive charges accumulated in the upper pixel electrode in the (n+1)th line through the previous writing operation can be transferred to one electrode of the positive/negative-charge capacitor 111 through the positive-charge recovery line. Then, the negative charges accumulated in the lower pixel electrode in the n-th line can be transferred to the other electrode of the positive/negative-charge capacitor 111 through the negative-charge recovery line.

After that, the charge recovery switch SW3 is turned off, and the common short switch SW2 and the pixel electrode switch SW8 in the (n+1) th line are turned on. At this time, the forward connection switch SW4 is kept on. With this wiring, the potential of the pixel electrode can be made equal to the common electrode potential. Then, the common short switch SW2 and the forward connection switch SW4 are turned off, and the charge recovery switch SW3 and the cross connection switch SW5 are turned on. With this wiring, charges accumulated in the positive/negative-charge capacitor 111 of the charge recovery circuit 104 are emitted and accumulated in the pixel electrode in the (n+1)th line.

More specifically, positive charges accumulated in the positive/negative-charge capacitor 111 are transferred to the lower pixel electrode in the (n+1)th line through the positive-charge recovery line. On the other hand, the negative charges are transferred to the upper pixel electrode in the (n+1)th line through the negative-charge recovery line.

After that, the charge recovery switch SW3 is turned off, and the switch SW1 is turned on to write the signal to the pixel electrode in the (n+1)th line. The display signal in the (n+1)th line has the polarity opposite to the display signal in the n-th line, so the cross connection switch SW5 and the pixel electrode switch SW8 in the (n+1) th line are kept on. By repeating the above process in this way, the display signals are written to the subsequent gate lines as well.

As mentioned above, the display signals are continuously supplied to the pixel electrode up to a target voltage level through four steps of charge recovery, common short, charge emission, and signal application from the operational amplifier. The charge recovery circuit 104 enables reuse of the charges transferred from the pixel electrode for the next writing. Besides, the common short circuit 105 makes the pixel electrode potential equal to the common electrode potential. Thus, at the time of writing the display signals, the operational amplifier 106 needs only to raise a potential by a small margin.

Further, the operational amplifiers 106 are divided into the one outputting positive polarity and the one outputting the negative polarity as described earlier, and the use of the dot inversion switch circuit 103 to switch between the two amplifiers allows each amplifier to output either one polarity. That is, it is possible to fix the amplitude of the display signals output from the operational amplifiers 106 to either positive or negative. Therefore, the total power consumption of the driver circuit 102 can be suppressed.

Further, since the charge recovery circuit 104 is provided, the voltage applied to the common short switch 114 of the common short circuit 105 can be suppressed. Therefore, the common short circuit 105 and the operational amplifier 106 can be manufactured through the low voltage process. Thus, the chip size of the driver circuit 102 can be reduced. In addition, in the case of using a switch of high withstand voltage, an on-resistance becomes too high due to an influence of back gate bias, so the common short takes much time with the conventional techniques. According to this embodiment, however, a switch of low withstand voltage can be used as the common short switch 114, making it possible to shorten a period necessary for the common short. This secures a longer writing period for the pixel electrode, minimizes the image degradation resulting from insufficient writing of the display signal, and improves the image quality.

In this embodiment, during the common short period, either the forward connection switch SW4 or the cross connection switch SW5 is turned on, but the present invention is not limited thereto. The common short period is divided into two. Preferably, in the first half of the period, the forward connection switch SW4 or the cross connection switch SW5 is turned on, and in the latter half of the period, the switch turned on in the first half is turned off, and the remaining switch is turned on. For example, in the common short period for the n-th frame, the cross connection switch SW5 is turned on during the first half, and the cross connection switch SW5 is turned off during the latter half, after which the forward connection switch SW4 is turned on. With the above settings, the potential of each pixel electrode can become equal to the common electrode potential without fail.

Second Embodiment

Figure 5:
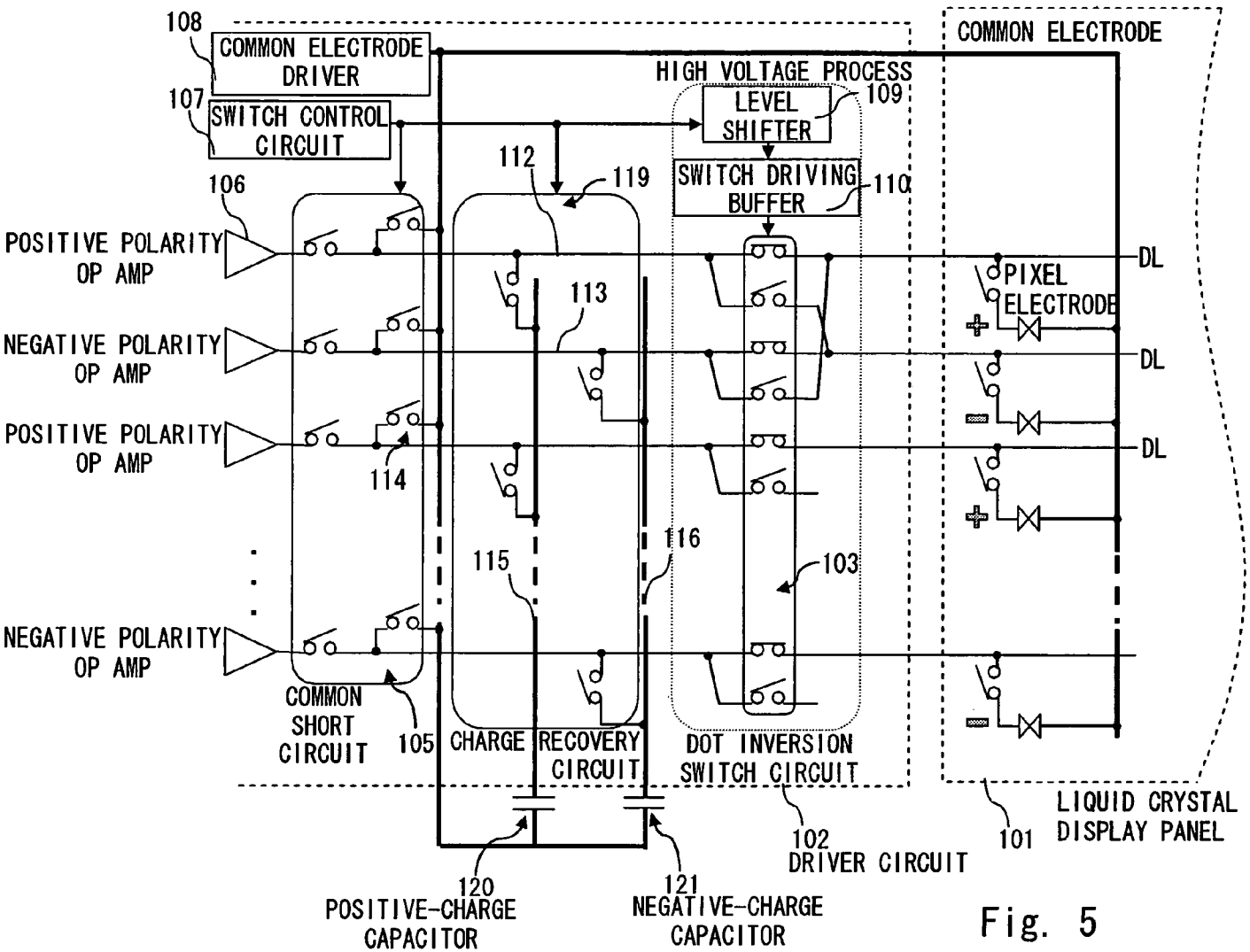
FIG. 5 shows the configuration of a driver circuit according to a second embodiment of the present invention.

FIG. 5 is a circuit diagram showing the driver circuit 102 according to a second embodiment of the present invention. The driver circuit 102 includes the dot inversion switch circuit 103, the charge recovery circuit 119, the common short circuit 105, the operational amplifier 106, the switch control circuit 107, the common electrode driver 108, the level shifter 109, and the switch driving buffer 110. In FIG. 5, the same components as the first embodiment are denoted by like reference numerals and their detailed description is omitted herein. The driver circuit 102 according to the second embodiment differs from that of the first embodiment in that the positive-charge capacitor 120 and negative-charge capacitor 121 are separately provided in the charge recovery circuit 119.

In this embodiment, the operational amplifier 106, the common short circuit 105, the charge recovery circuit 104, and the dot inversion switch circuit 103 are arranged in the stated order. The liquid crystal display panel 101 is provided on the output side of the dot inversion switch circuit 103.

The charge recovery circuit 119 recovers the positive charges accumulated in the pixel electrode through the source line DL into the positive-charge capacitor 120, and recovers the negative charges into the negative-charge capacitor 121. Upon the writing of the positive display signal to the pixel electrode, charges recovered to the positive-charge capacitor 120 are emitted. In contrast, upon the writing of the negative display signal to the pixel electrode, charges recovered to the negative-charge capacitor 121 are emitted and supplied to the pixel electrode. In this way, the positive-charge capacitor 120 and the negative-charge capacitor 121 are separately provided, making it possible to manufacture the charge recovery circuit 119 based on a low-voltage process, and moreover to reduce the chip size of the driver circuit 102.

The charge recovery circuit 119 includes the positive-charge recovery line 115, the negative-charge recovery line 116, the charge recovery switch 117, the positive-charge capacitor 120, and the negative-charge capacitor 121. The positive-charge recovery line 115 is arranged orthogonally to the positive-polarity line 112 and connected with one electrode of the positive-charge capacitor 120. Further, the negative-charge recovery line 116 is arranged orthogonally to the negative-polarity line 113 and connected with one electrode of the negative-charge capacitor 121. In addition, other electrodes of the positive-charge capacitor 120 and negative-charge capacitor 121 are connected with the common electrode.

Figure 6A:
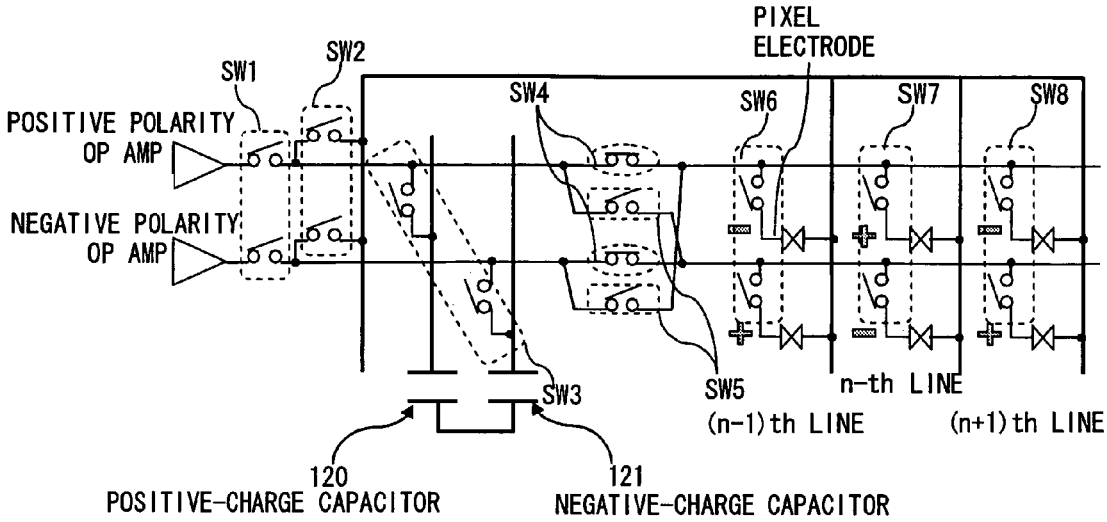
FIG. 6A illustrates an operation of the driver circuit according to the second embodiment.
Figure 6B:
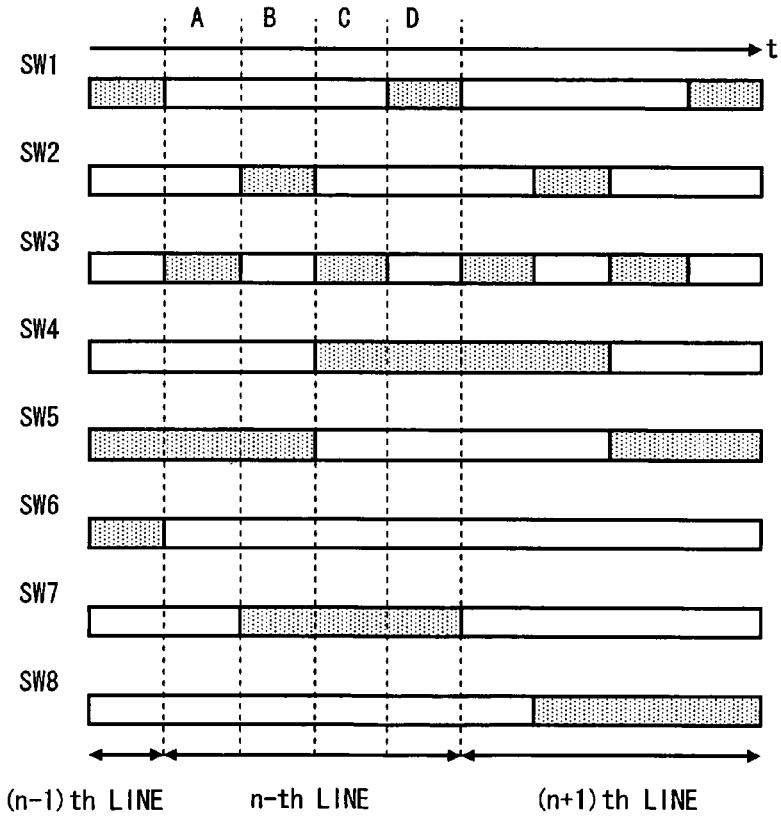
FIG. 6B is a timing chart illustrative of on/off timings of each switch of the driver circuit according to the second embodiment.
Figure 7:
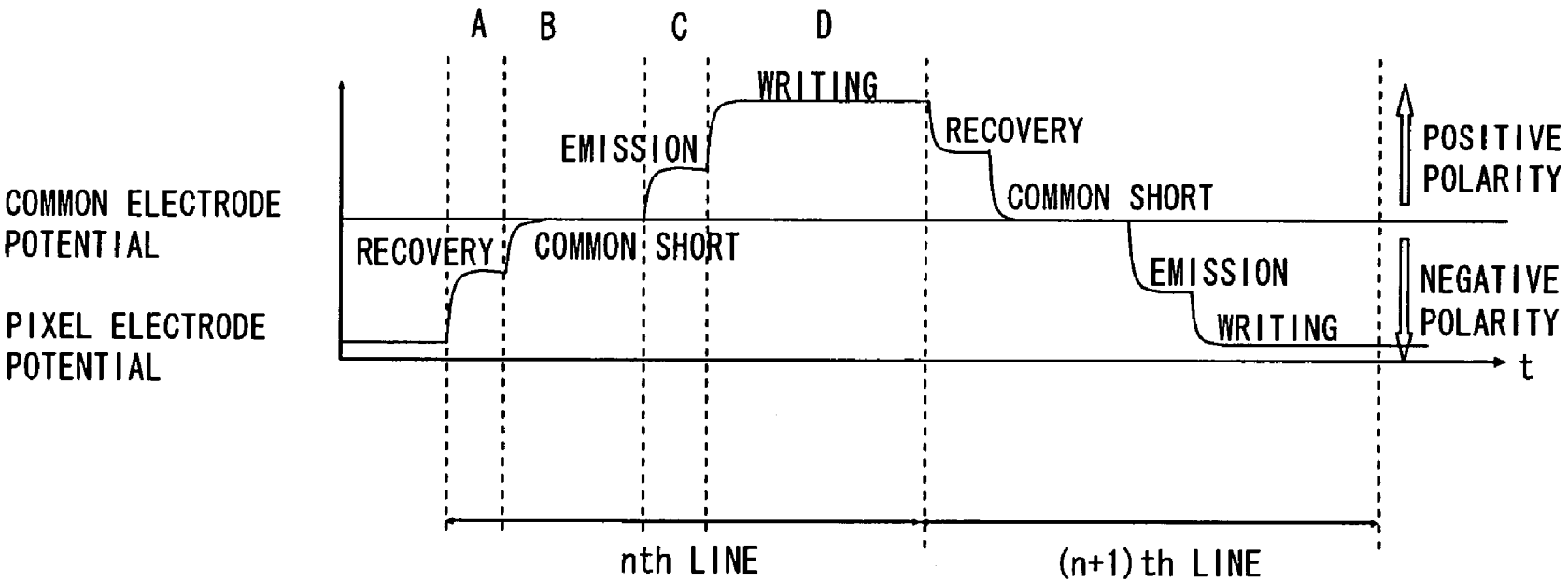
FIG. 7 is a waveform diagram showing the potential of a pixel electrode with the use of the driver circuit according to the second embodiment.

Referring now to FIGS. 6A to 7, the operation of the driver circuit 102 according to the second embodiment is described. FIGS. 6A and 6B illustrate the operation of the driver circuit 102. FIG. 6A illustrates two adjacent pixel electrodes connected with the (n−1)th gate line, n-th gate line, and (n+1)th gate line. FIG. 6B is a timing chart illustrative of on/off timing of each switch. In a hatched period of FIG. 6B, the stitches are turned on. FIG. 7 shows a potential waveform of an upper pixel of the n-th line of FIG. 6A. The periods A to D in FIG. 6B correspond to the periods A to D of FIG. 7.

The operational timings of the driver circuit according to this embodiment are the same as the driver circuit of the first embodiment except that it is determined which capacitor is used to accumulate charges depending on the polarity of charges recovered/emitted in the charge recovery period A/charge emission period C. To elaborate, during the charge recovery period A, negative charges, which have been accumulated in the upper pixel electrode in the n-th line during the previous writing operation, are transferred to the negative-charge capacitor 121 through the negative-charge recovery line. On the other hand, positive charges accumulated in the lower pixel electrode in the n-th line are transferred to the positive-charge capacitor 120 through the positive-charge recovery line.

As mentioned above, the positive-charge capacitor and the negative-charge capacitor are separately provided as the charge recovery capacitor, whereby as set forth in the first embodiment, the common short circuit 105 can be manufactured with the low voltage process, and besides, the charge recovery circuit 119 can be manufactured with the low voltage process. This contributes to further reduction in chip size.

In the case of using a switch of high withstand voltage, an on-resistance becomes too high due to an influence of back gate bias, so it takes much time to recover/emit charges with the conventional techniques. According to this embodiment, however, a switch of low withstand voltage can be used as the charge recovery switch of the charge recovery circuit 119, making it possible to shorten a period necessary for the charge recovery/emission (see charge recovery period A and charge emission period C of FIG. 7). This secures a longer writing period for the pixel electrode (see writing period D of FIG. 7), minimizes the image degradation resulting from insufficient writing of the display signal, and improves the image quality.

Figure 8:
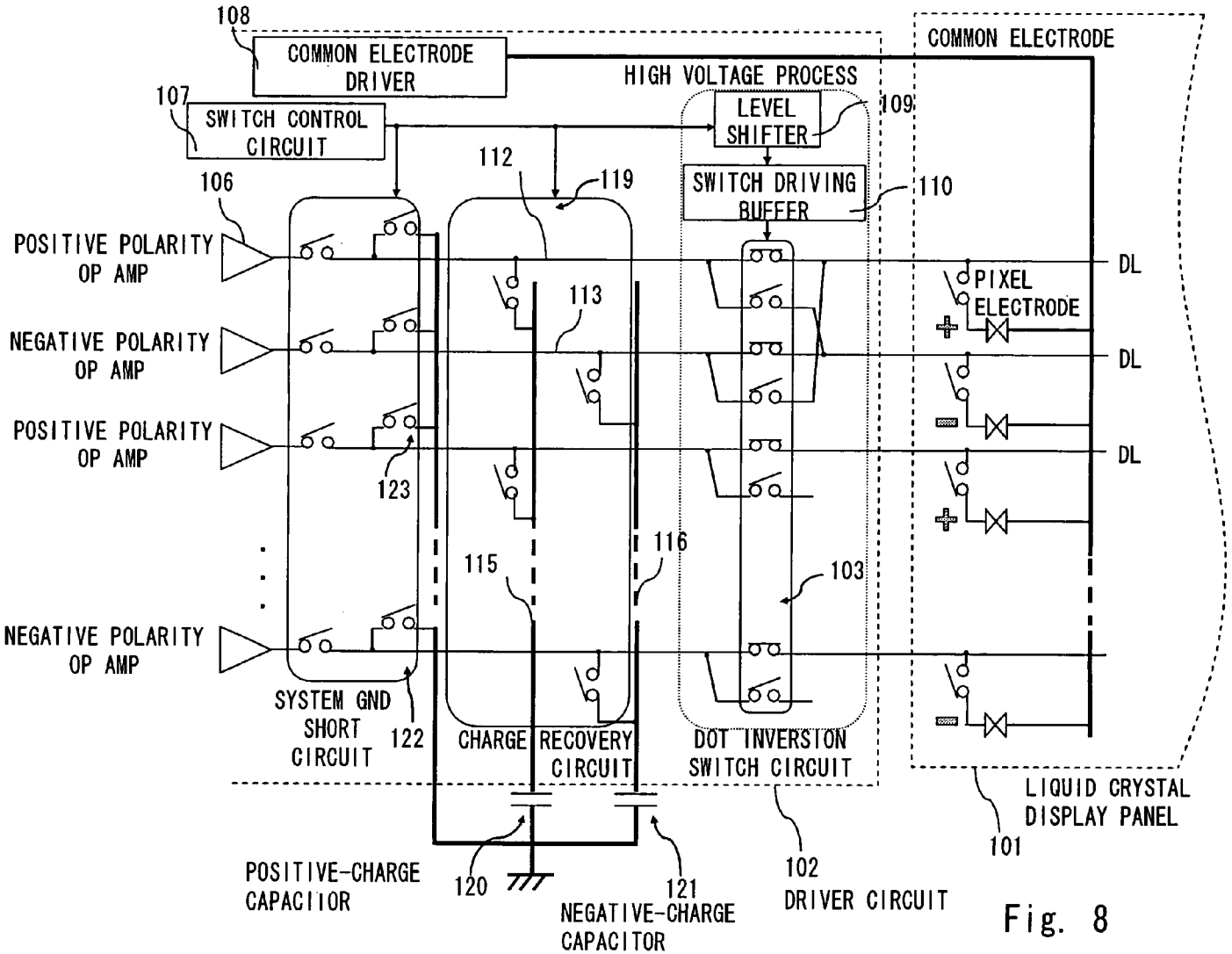
FIG. 8 shows another configuration of the driver circuit according to the second embodiment.

Further, as another structural example of the driver circuit according to the second embodiment in which the positive-charge capacitor and the negative-charge capacitor are separately provided in the charge recovery circuit 119, the structure of FIG. 8 may be adopted. The driver circuit of FIG. 8 differs from the foregoing driver circuit of FIG. 5 in that the common electrode driver 108 is not connected with the charge recovery circuit 119, and the charge recovery circuit 119 is connected with a system GND.

As shown in FIG. 8, the driver circuit 102 of this example includes an operational amplifier 106, a system GND short circuit 122, a charge recovery circuit 104, and a dot inversion switch circuit 103. In this example, the operational amplifier 106, system GND short circuit 122, the charge recovery circuit 104, and the dot inversion switch circuit 103 are arranged in the stated order. The liquid crystal display panel 101 is placed on the output side of the dot inversion switch circuit 103.

The system GND short circuit 122 of this example corresponds to the common short circuit 105 of the driver circuit according to the foregoing embodiment shown in FIG. 2 and FIG. 5. The common short circuit 105 of the driver circuit according to the foregoing embodiment shown in FIG. 2 and FIG. 5 shorts the pixel electrode to the common electrode potential supplied from the common electrode driver 108 as a reference voltage, saving the power consumption. The system GND short circuit 122 of this example shorts the pixel electrode to the system GND as the reference voltage, saving the power consumption. The system GND short circuit 105 includes plural system GND short switches 123. The positive-polarity line 112 and the negative-polarity line 113 are each connected with the system GND short switches 123. The system GND short switch 123 functions to connect the positive-polarity line 112 and negative-polarity line 113 to the system GND. The system GNDs are provided in several positions on the circuit substrate in many cases. As in this example, the system GND is used as the reference voltage, thereby eliminating the need to lead the line from the common electrode driver 108, and simplifying the circuit configuration.

The charge recovery circuit 119 includes the positive-charge recovery line 115, the negative-charge recovery line 116, the charge recovery switch 117, the positive-charge capacitor 120, and the negative-charge capacitor 121. The positive-charge recovery line 115 extends orthogonally to the positive-polarity line 112, and is connected with one electrode of the positive-charge capacitor 120. Further, the negative-charge recovery line 116 extends orthogonally to the negative-polarity line 113, and is connected with one electrode of the negative-charge capacitor 121. The other electrodes of the positive-charge capacitor 120 and negative-charge capacitor 121 are connected with the system GND.

The operational timings of the driver circuit of FIG. 8 are the same as those of FIG. 6B. As mentioned above, the charges accumulated in the pixel electrode are transferred to either the positive-charge capacitor 120 or the negative-charge capacitor 121 depending on the polarity thereof during the charge recovery period A and the charge emission period C upon the recovery/emission.

Therefore, the positive-charge capacitor 120 and the negative-charge capacitor 121 are separately provided as the charge recovery capacitor as discussed above, so the common short circuit 105 can be manufactured through the low voltage process as in the first embodiment, and in addition, the charge recovery circuit 119 can be manufactured through the low voltage process. This contributes to further reduction in chip size. Further, a switch of low withstand voltage can be used as the charge recovery switch of the charge recovery circuit 119, making it possible to shorten a period necessary for the charge recovery/emission. This secures a longer writing period for the pixel electrode, minimizes the image degradation resulting from insufficient writing of the display signal, and improves the image quality.

Further, in this example, the common short period B of FIGS. 6A to 7 corresponds to the system GND short period. More specifically, the system GND short switch 123 is turned on, and the pixel electrode potential is made equal to the system GND potential through the system GND short circuit 122. Therefore, in this example, as mentioned above, the display signals are continuously supplied to the pixel electrode up to a target voltage level through four steps of charge recovery, common short, charge emission, and signal application from the operational amplifier. Thus, at the time of writing the display signals, the operational amplifier 106 needs only to raise a potential by a small margin to save the total power consumption of the driver circuit.

In this example as well, as described above, it is possible that the system GND short period may be divided into two: the first half of the period during which the forward connection switch SW4 or the cross connection switch SW5 is turned on, and the latter half of the period during which the switch turned on in the first half is turned off, and the remaining switch is turned on.

Third Embodiment

Figure 9:
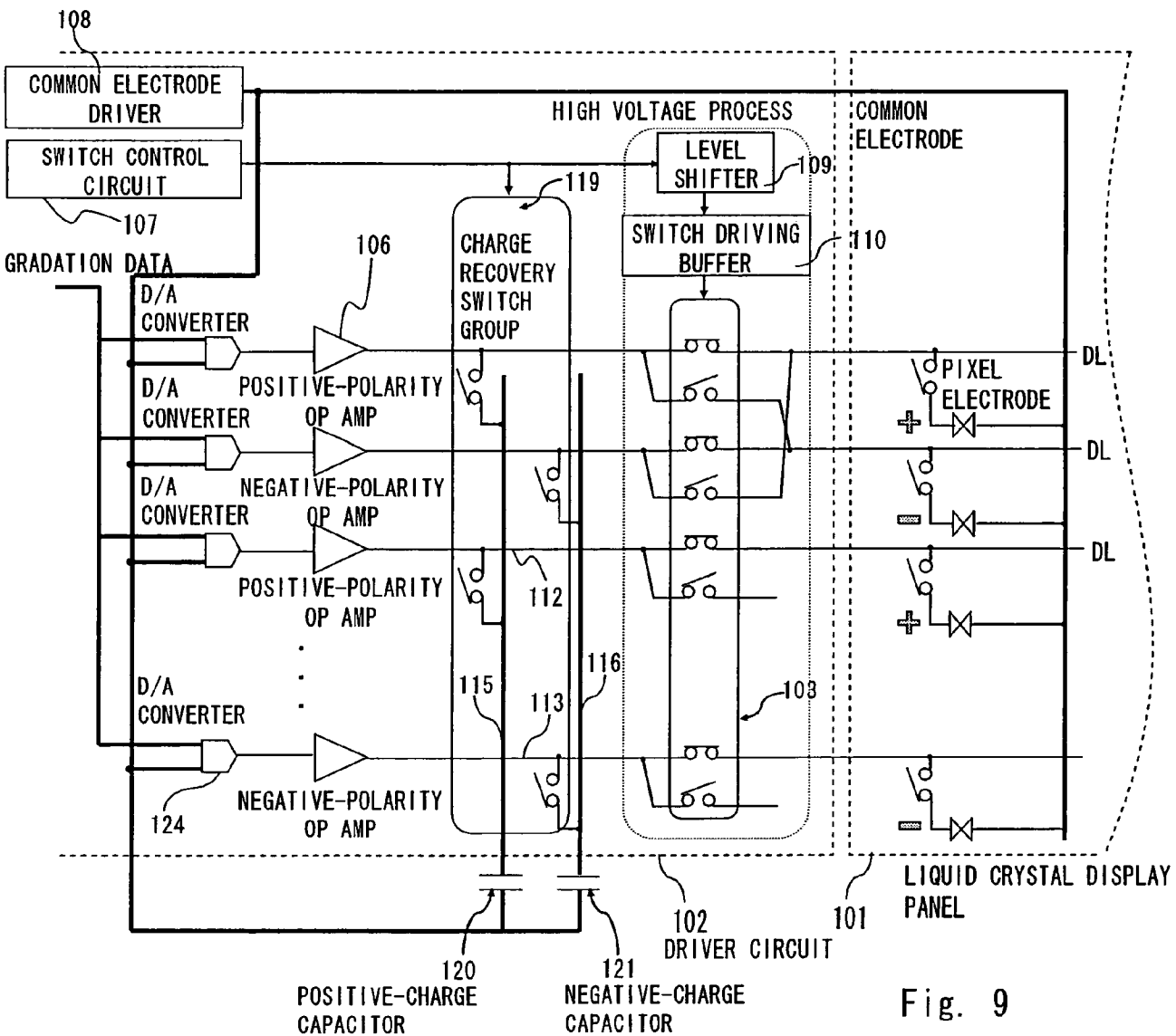
FIG. 9 shows the configuration of a driver circuit according to a third embodiment of the present invention.

FIG. 9 is a circuit diagram showing the driver circuit 102 according to a third embodiment of the present invention. The driver circuit 102 includes the dot inversion switch circuit 103, the charge recovery circuit 119, the operational amplifier 106, the switch control circuit 107, the common electrode driver 108, the level shifter 109, the switch driving buffer 110, and a D/A converter 124. In FIG. 9, the same components as the first embodiment are denoted by like reference numerals, and their description is omitted here. The driver circuit 102 of the third embodiment is different from the second embodiment in that the common short circuit 105 is omitted, and the D/A converter 124 is provided on the input terminal side of the operational amplifier 106.

The input side of the D/A converter 124 is connected with the gradation data transmission line and a line transmitting common electrode data output from the common electrode driver 108. The D/A converter 124 converts digital gradation data generated in the driver circuit 102 into analog data to send it to the operational amplifier 106. Further, the D/A converter 124 outputs analog data corresponding to the common electrode potential. With this operation, the common short can be induced by means of the driving ability of the operational amplifier 106, so the time necessary for the common short can be reduced as compared with the case of using the common short circuit 105. Hence, the writing time of the display signal to the pixel electrode can be lengthened, and the low power consumption is realized.

Figure 10A:
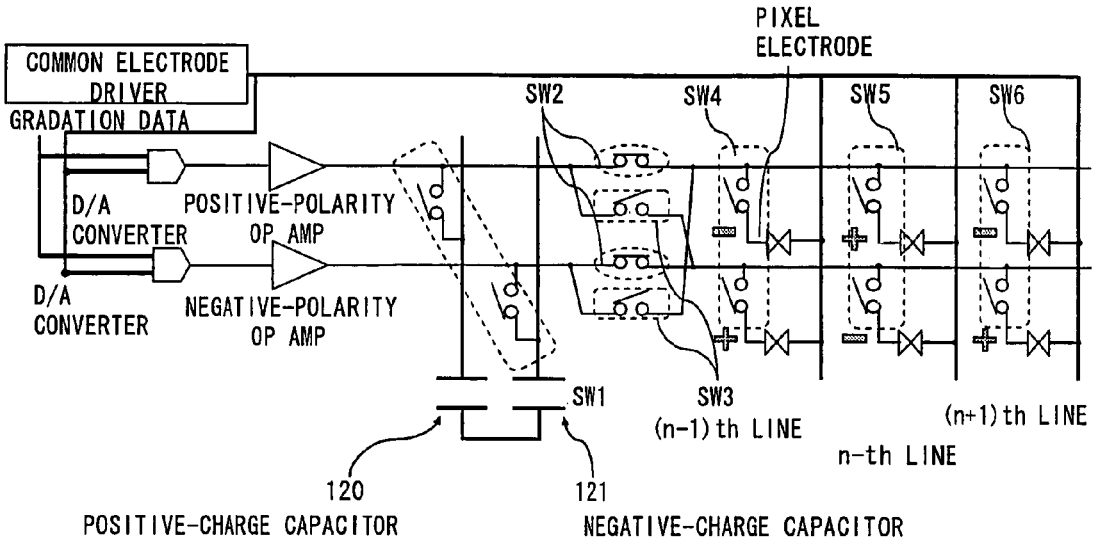
FIG. 10A illustrates an operation of the driver circuit according to the third embodiment.
Figure 10B:
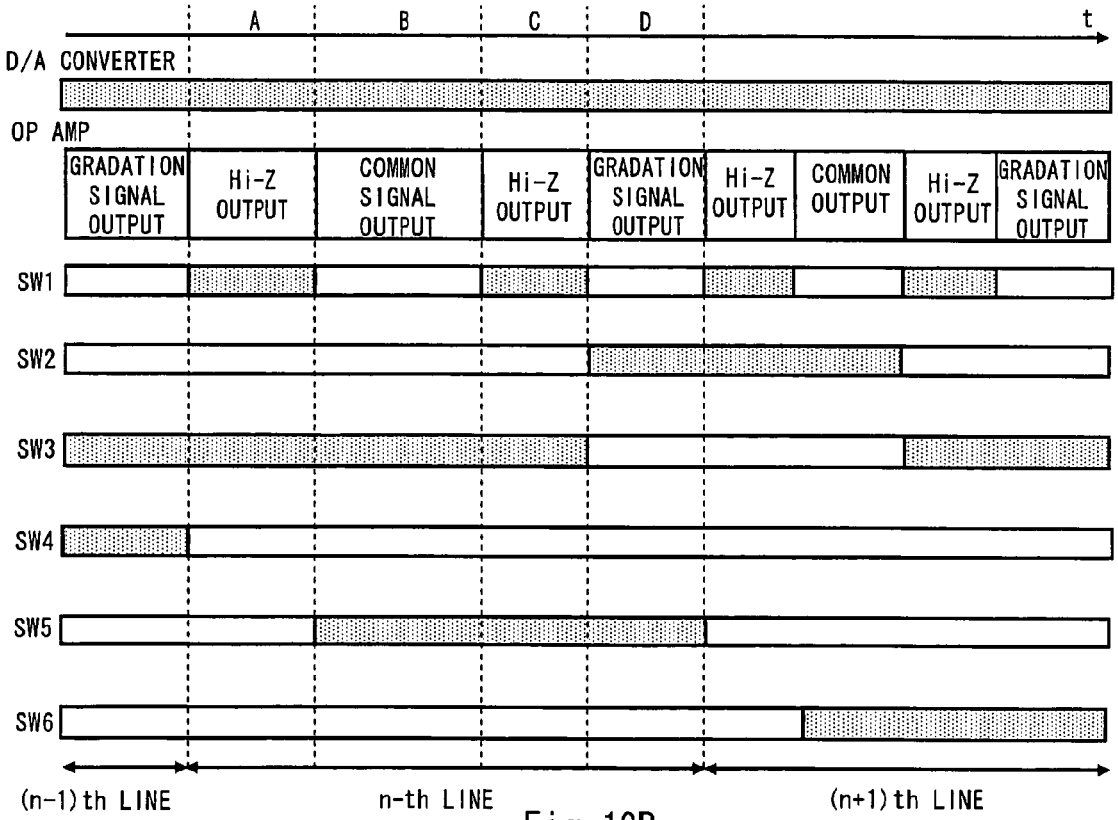
FIG. 10B is a timing chart illustrative of on/off timings of each switch of the driver circuit according to the third embodiment.
Figure 11:
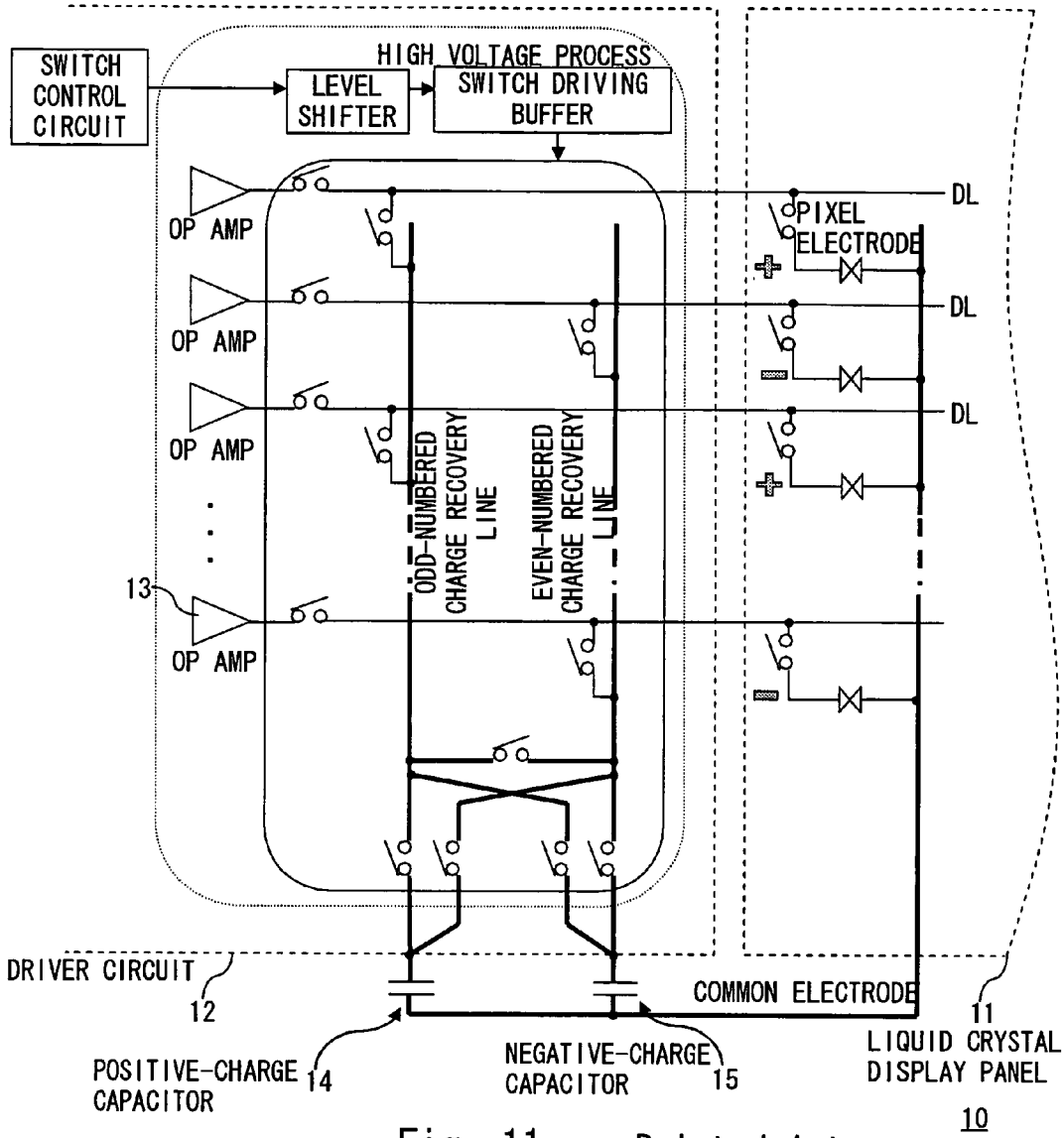
Fig. 11 Related Art
FIG. 11 shows the configuration of a conventional driver circuit.

Referring now to FIGS. 10A and 10B, an operation of the driver circuit 102 according to the third embodiment is described. FIGS. 10A and 10B show the operation of the driver circuit 102. FIG. 10A shows the two adjacent pixel electrodes connected with the (n−1)th gate line, n-th gate line, and (n+1)th gate line. FIG. 10B is a timing chart showing on/off timings of each switch. In a hatched period of FIG. 10B, a switch is turned on. A period A of FIG. 10B is a charge recovery period, a period B is a common short period, a period C is a charge emission period, and a period D is a writing period.

First, the display signal is written to the pixel electrode in the (n−1)th line. The D/A converter 124 is on all the time and outputs a gradation data, so that the operational amplifier 106 outputs the display signal corresponding to the desired gray scale. At this time, the cross connection switch SW3 and the pixel electrode switch SW4 in the (n−1)th line are turned on, and the negative display signal and the positive display signal are supplied to the upper pixel and the lower pixel, respectively. Next, charges are supplied to the pixel electrode in the n-th line. The switch SW4 in the (n−1) th line is turned off, while the charge recovery switch SW1 is turned on. Further, the operational amplifier 106 outputs a Hi-Z signal. At this time, the cross connection switch SW3 turned on at the time of writing the signal to the (n−1) th line is kept on (charge recovery period A). With this wiring, negative charges accumulated in the upper pixel electrode in the n-th line during the previous writing operation can be recovered to the negative-charge capacitor 121. Also, the positive charges accumulated in the lower pixel electrode can be recovered to the positive-charge capacitor 120.

After that, the charge recovery switch SW1 is turned off, and the pixel electrode in the n-th line switch SW5 is turned on. Further, the operational amplifier 106 outputs a common short signal corresponding to the common electrode potential (common short period B). At this time, the cross connection switch SW3 is kept on. With this wiring, the potentials of all the pixel electrodes are made equal to the common electrode potential.

Then, the cross connection switch SW3 is turned off, and the charge recovery switch SW1 and the forward connection switch SW2 are turned on. At this time, the operational amplifier 106 outputs the Hi-Z signal (charge emission period C). With this wiring, either the positive charges accumulated in the positive-charge capacitor 120 of the charge recovery circuit 119 or negative charges accumulated in the negative-charge capacitor 121 are emitted and transferred to either the upper or lower pixel electrode in the n-th line.

Thereafter, the charge recovery switch SW1 is turned off, the operational amplifier 106 outputs the gradation signal, and the signal is written to the pixel electrode in the n-th line (writing period D). The polarity of the display signal in the n-th line is opposite to that of the (n−1)th line, so the forward connection switch SW2 and the pixel electrode switch SW5 in the n-th line are kept on.

Next, charges are supplied to the pixel electrode in the (n+1)th line. The switch SW5 is turned off while the charge recovery switch SW1 is turned on. Besides, the operational amplifier 106 outputs the Hi-Z signal. At this time, the forward connection switch SW2 turned on during the writing operation to the n-th line is kept on. With this wiring, positive and negative charges, which were accumulated in the pixel electrodes in the (n+1)th line during the previous writing operation to the n-th line, can be recovered to the positive-charge capacitor 120 and the negative-charge capacitor 121 of the charge recovery circuit 119.

After that, the charge recovery switch SW1 is turned off, and the pixel electrode in the (n+1)th line switch SW6 is turned on. Then, the operational amplifier 106 outputs the common short signal. At this time, the forward connection switch SW2 is kept on. With this wiring, the pixel electrode potential is made equal to the common electrode potential. Following this, the forward connection switch SW2 is turned off, and the charge recovery switch SW1 and the cross connection switch SW3 are turned on. With this wiring, charges accumulated in the positive-charge capacitor 120 and the negative-charge capacitor 121 of the charge recovery circuit 119 are emitted and accumulated in the pixel electrode in the (n+1)th line.

More specifically, negative charges accumulated in the negative-charge capacitor 121 are transferred to the upper pixel electrode in the (n+1)th line, and positive charges accumulated in the positive-charge capacitor 120 are transferred to the lower pixel electrode.

After that, the charge recovery switch SW1 is turned off, the operational amplifier 106 outputs the gradation signal, and the signal is written to the pixel electrode in the (n+1)th line. The display signal in the (n+1)th line has the polarity opposite to that of the n-th line, so the cross connection switch SW3 and the pixel electrode switch SW6 in the (n+1)th line are kept on. The above process is repeated this way to thereby write the display signals to subsequent gate lines.

As described in the embodiments, the common short circuit 105 can be manufactured through the low voltage process, and besides, the charge recovery circuit 119 can be manufactured through the low voltage process as well. Hence, the chip size can be further reduced.

Moreover, the common short can be induced by means of the driving ability of the operational amplifier 106, so the time necessary for writing the display signal to the pixel electrode can be lengthened. With this operation, it is possible to suppress the degradation of the display performance due to the insufficient writing of the display signals to the pixel electrode. Further, in order to accelerate the writing to the pixels, and charge recovery/emission, the switch should be enlarged. However, according to the present invention, the switch size can be further reduced, and the display signals can be supplied at higher speeds.

As mentioned above in this embodiment, it is preferred that the common short period be divided into two: the first half of the period during which the forward connection switch SW4 or the cross connection switch SW5 is turned on, and the latter half of the period during which the switch turned on in the first half is turned off, and the remaining switch is turned off.

In the above description, the driver circuit 102 is externally connected to the liquid crystal display panel 101, but the present invention is not limited thereto. For example, the driver circuit is formed on the TFT array substrate in the form of being connectable to all the source lines DL.

It is apparent that the present invention is not limited to the above embodiment and it may be modified and changed without departing from the scope and spirit of the invention.

What is claimed is:

1. A driver circuit for inversion-driving a display panel, comprising:

a common short circuit selectively connecting each of a positive-polarity line and a negative polarity line to a common electrode that is connected to a common electrode driver for the display panel, the positive-polarity line transmitting a positive display signal relative to a reference voltage and the negative-polarity line transmitting a negative display signal relative to the reference voltage;

a charge recovery circuit that receives outputs from the common short circuit, the positive-polarity line being connected to the charge recovery circuit through a first switching element and the negative-polarity line being connected to the charge recovery circuit through second switching element; and a switching part that receives outputs from the charge recovery circuit and selectively connects the positive-polarity line and the negative-polarity line with a source line.

2. The driver circuit according to claim 1, wherein the reference voltage is one of a common voltage applied to the common electrode and a system ground voltage.

3. The driver circuit according to claim 1, further comprising at an input to the common short circuit:

a positive-polarity operational amplifier connected with the positive-polarity line and outputting the positive display signal; and a negative-polarity operational amplifier connected with the negative-polarity line and outputting the negative display signal.

4. The driver circuit according to claim 1, wherein the charge recovery part includes charge recovery lines and charge recovery capacitors, and each of the charge recovery lines and the charge recovery capacitors are separately provided for positive charge recovery and negative charge recovery.

5. The driver circuit according to claim 4, wherein the switching part selects the charge recovery capacitor for the positive charge recovery or the charge recovery capacitor for the negative charge recovery.

6. A display device comprising the driver circuit according to claim 4, wherein the switching part, the first switching element, and the second switching element are provided on a substrate constituting the display panel, and the charge recovery capacitors are externally connected with the substrate.

7. A display device, comprising the driver circuit according to claim 1.

* * * * *